United States Patent [19]

Shiba et al.

[11] 3,961,960

[45] June 8, 1976

[54] MULTILAYER COLOR PHOTOGRAPHIC MATERIALS

[75] Inventors: Keisuke Shiba; Takeshi Hirose; Jun Hayashi; Atsuaki Arai; Nobuo Furutachi; Harumi Katsuyama, all of Minami-ashigara, Japan

[73] Assignee: Fuji Photo Film Co., Ltd., Minami-ashigara, Japan

[22] Filed: June 19, 1974

[21] Appl. No.: 480,802

[30] Foreign Application Priority Data

June 19, 1973 Japan ..... 48-68892

[52] U.S. Cl. ..... 96/74; 96/7; 96/100; G03C/1/40

[51] Int. Cl.[2] ..... G03C 1/76; G03C 7/04; G03C 1/40

[58] Field of Search ..... 96/74, 7, 55, 22, 100

[56] References Cited

UNITED STATES PATENTS 2,927,019 3/1960 Woodward et al. ..... 96/7

*Primary Examiner*—Mary F. Kelley
*Assistant Examiner*—L. V. Falasco
*Attorney, Agent, or Firm*—Sughrue, Rothwell, Mion, Zinn & Macpeak

[57] ABSTRACT

A multilayer color photographic material with improved color reproduction comprising a support having thereon at least two photosensitive silver halide emulsion layers which provide color images having different colors from each other, the multilayer color photographic material containing at least one interlayer color correction coupler as defined hereinafter.

11 Claims, 5 Drawing Figures

MULTILAYER COLOR PHOTOGRAPHIC MATERIALS

BACKGROUND OF THE INVENTION

1. Field of the Invention

The present invention relates generally to a color photographic material having improved color reproduction characteristics and, more particularly the invention relates to a color photographic material which provides excellent and faithful color reproduction by using the interlayer color correction couplers in an improved manner.

2. Description of the prior Art

A multilayer color photographic material is usually composed of a support having thereon a photosensitive layer unit which is mainly sensitive to blue light (light of a wave length shorter than substantially about 500 nm.) and which contains a yellow coupler, a photosensitive emulsion layer unit which is mainly sensitive to green light (light of a wave length in a range of substantially from about 500 to about 600 nm) and which contains a magenta coupler, and a photosensitive emulsion layer which is mainly sensitive to red light (light of wave length longer than substantially about 590 nm) and which contains a cyan coupler. Each of these photosensitive emulsion layer units independently must fulfill its own function of specific color reproduction and for the purpose, intermediate layers, a light filter layer containing an ultraviolet absorber, an anti-halation layer, and a protective layer are formed additionally in the multilayer color photographic material. Also, each of the photosensitive emulsion layer units contains, independent of each other, a silver halide photosensitive emulsion having a spectral sensitivity of an appropriate distribution in a proper and specific wave length region and a coupler capable of providing a color image having appropriate spectral absorption characteristics. However, color photographic materials produced at present have various deficiencies.

A first deficiency in color reproduction is in the spectral absorption characteristics of the colored dye image obtained from the coupler used, that is, in that the colored dye image obtained has insufficient absorption in the specific wave length region and in addition has undesired absorptions in other wave length regions. Such a deficiency results in narrowing the color reproduction region and difference in color and reduction in color saturation.

A second deficiency is that the development of a specific photosensitive emulsion layer induces the coupling of a coupler in an adjacent photosensitive emulsion layer. This deficiency causes color mixing and, in particular, reduces color saturation.

A third deficiency is that the sensitizing dye used for the spectral sensitization of a specific photosensitive emulsion layer diffuses into an adjacent photosensitive emulsion layer to sensitive the adjacent emulsion layer and results in an improper spectral sensitization distribution.

Approaches toward improving these deficiencies have involved the provision of, for instance, intermediate layers and a filter layer and further the incorporation of a reducing compound, a hydroquinone derivative, a phenol derivative, an ascorbic acid derivative, a scavenger for the oxidattion product of an aromatic primary amino color developing agent, a colorless coupling compound, a coupler forming a diffusible dye, a diffusion preventing agent for the sensitizing dye and coupler, fine silver halide grains, a clay such as colloidal silica and hematite, an anionic or nonionic or cationic surface active agent, a cationic hydrophilic synthetic polymer, a hydroquinone derivative hydrophilic synthetic polymer, and a polymer latex in such auxiliary layers. However, such improvements have not sufficed.

Another manner of improving the occurence of color mixing is in the introduction of photographic elements affirmatively possessing a color correction function. One technique is the use of a colored coupler equipped with an automatic masking function. These techniques are described in, for instance, U.S. Pat. Nos. 2,455,170; 2,449,966; 2,600,788; 2,428,054; 3,148,062; and 2,983,608, British Pat. No. 1,044,778, and U.S. patent application Ser. No. 462,842, filed Apr. 22, 1974 (Attorneys Docket No. Q-1580, corresponding to Japanese Pat. Application No. 45971/1973). However, these processes as described in the above patent art have the defect that the nonexposed portions are strongly colored. Therefore, colored couplers such as those disclosed above have not been used for color photographic positive materials and in addition when these colored couplers are used for color photographic negative materials, a long period of time is required for exposing the photographic materials at printing, which results in reducing the efficiency of printing work. Also, the use of such colored couplers tends to increase the formation of fogs, which results in reducing the granularity of the dye images.

A second technique is a process using the so-called "DIR coupler", or "development inhibitor-releasing coupler". The DIR coupler is defined in C. R. Barr, J. R. Thirtle, and P. W. Vittum, *Photographic Science and Engineering*, Vol. 13, 74N, 80(1969), bid., 214-217(1969), and U.S. Pat. No. 3,227,554. It is generally known that the DIR coupler provides an interlayer effect but the coupler has the disadvantages that the development is delayed, the gradation (gamma) is reduced, the maximum coloring density ($D_{max}$) is reduced, and the effective sensitivity is also reduced. It can be said that the improvement of these disadvantages is a technical theme of color reproduction.

A third technique is a process using a substantially fogged silver halide emulsion or a direct positive silver halide emulsion in an intermediate layer. In addition, a process using a coupler together with the aforesaid silver halide emulsion, a process using an internal fogged type silver halide emulsion or an internal latent image type silver halide emulsion, and a process utilizing a Luckey effect are known. However, the use of such silver halide emulsions is accompanied by a reduction in sharpness caused by the scattering of exposure light by the silver halide grains, the difficulty in controlling the photographic characteristics of the emulsion itself, and also photographic side reactions.

A forth technique is a process of controlling the composition of the silver halide emulsion itself used in each photosensitive emulsion unit, a process of controlling the inter-layer distribution of development accelerator, or a process of controlling the inter-layer distribution of a development inhibitor.

However, the color correction effects by the proposed processes are insufficient.

In another approach an element included in a development process is provided but the color correction effect by such an element is still insufficient.

As a process of improving the deficiency in color reproduction due to the insufficient absorptions in specific wave length regions by dye images from couplers used, a process in which a mixture of two or more couplers which form dye images having different colors as described in, for instance, the specification of Japanese Patent Publication No. 391/1965, is used.

However, since conventional couplers have, as mentioned above, undesired absorptions, the formation of "color mixing", increases on the contrary and thus by the proposed process color reproduction in a specific color may be improved but desirable excellent color reproduction is not obtained for all colors of interest, such as red, green, yellow, and intermediate colors.

It is also known that the photosensitive characteristics of a green-sensitive emulsion layer unit and a red-sensitive emulsion layer unit, in particular the photosensitive characteristics of a green-sensitive emulsion layer unit of the photosensitive emulsion layer units of a multilayer color photographic material and the colors of the dye images formed therefrom have the greatest influence on color reproduction. Also, various interlayer color correction uncolored couplers and so-called "DIR couplers" are known as described in, for instance, U.S. Pat. Nos. 3,006,759; 3,227,554; 3,632,345; 3,622,328; 3,617,291; 3,632,373; 3,642,485; 3,649,285; and 3,701,783 and U.S. pat. application Ser. No. 454,525, filed Mar. 25, 1974.

Of the compounds described in the patent art described immediately above, the interlayer color correction uncolored couplers and the DIR couplers each having a pyrazolone nucleus have large defects for practical uses. For instances, a first defect is that the industrial production of such compounds is not easy. Thus, the cost of the compounds increases and also it is difficult to obtain those compounds at sufficiently high and constant quality. A second defect is that the interlayer color correction pyrazolone coupler and the DIR pyrazolene coupler each having a sufficiently high coupling reactivity to a color developer are chemically unstable. This results in desensitization of the silver halide emulsion containing this coupler, delay in the progress of development, and tendency to form stain.

SUMMARY OF THE INVENTION

An object of this invention is to provide a multilayer color photographic material which does not have the deficiencies as described above. That is to say, an object of this invention is, in particular, to provide a multilayer color photographic material having excellent color reproducibility by improving the spectral characteristics of the dye image formed in each photosensitive emulsion layer unit thereof using an interlayer color correction uncolored coupler and correcting the desired absorptions by increasing the interimage effect.

Another object of this invention is to provide a multilayer color photographic material having in the green-sensitive and red-sensitive emulsion layers or, in particular, in the green-sensitive emulsion layer an interlayer color correction uncolored coupler which does not possess the aforesaid various defects.

Still another object of this invention is to provide a multilayer color photographic material capable of forming dye images having improved red or vermilion color reproducibility, or dark green or fresh green color reproducibility, or lemon yellow color reproducibility.

These and other objects of this invention will become apparent from the descriptions in this specification.

The above objects of this invention can be attained as follows. This invention provides a multilayer color photographic material comprising a support having coated thereon at least two photosensitive silver halide emulsion layer units which provide, on color development, dye images having substantially different colors from each other, each of the photosensitive emulsion layer units containing a coupler capable of undergoing a coupling reaction with the oxidation product of a primary aromatic amine color developing agent and an interlayer color correction coupler which provides a different color fromm the color of the dye formed by the aforesaid coupler upon coupling with the oxidation product of the primary aromatic amine color developing agent.

DETAILED DESCRIPTION OF THE INVENTION

Figure 1:
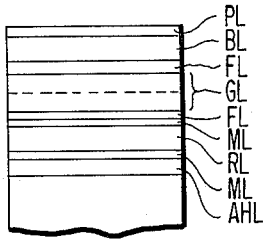
FIGS. 1 to 5 are schematic cross-sectional views showing, respectively, five embodiments of the multilayer structures of the color photographic materials of this invention.

In particular, it is preferable that the multilayer color photographic material of this invention has at least a blue-sensitive emulsion layer unit (BL), a green-sensitive emulsion layer unit (GL), and a red-sensitive emulsion layer unit (RL) and further it is desired that the photographic emulsion units of the multilayer color photographic material are in one of the following states:

1. The green-sensitive emulsion layer unit contains a magenta coupler and a yellow interlayer color correction coupler.
2. The green-sensitive emulsion layer unit contains a magenta coupler, a yellow interlayer color correction coupler and a colored magenta coupler.
3. The green-sensitive emulsion layer unit contains a magenta coupler and a cyan interlayer color correction coupler.
4. The green-sensitive emulsion layer unit contains a magenta coupler, a cyan interlayer color correction coupler, and a colored magenta coupler.
5. The red-sensitive emulsion layer unit contains a cyan coupler and a yellow interlayer color correction coupler.
6. The red-sensitive emulsion layer unit contains a cyan coupler, a yellow interlayer color correction coupler, and a colored cyan coupler.
7. The blue-sensitive emulsion layer unit contains a yellow coupler and a cyan interlayer color correction coupler.

The term "interlayer color correction coupler" used in this invention designates a coupler which can provide an interlayer interimage effect and has, as the result thereof, the function of "color correction". Such a coupler includes the couplers described in the specification of U.S. patent application Ser. No. 454,525, filed Mar. 25, 1974 and the so-called "DIR couplers or development inhibitor-releasing couplers".

The couplers and the interlayer color correction couplers used in this invention are explained in greater detail below.

As the nucleus coupler or coupler residue of the interlayer color correction coupler used in this invention, there is a compound capable of being colored by color development with a primary aromatic amine color developing agent, such as, for instance, a phenylenediamine derivative, an aminophenol derivative, etc. Specific examples of such a compound are an open chain acylacetonitrile coupler, an acylacetyl coupler such as an acylacetanilide coupler, an alkoylacetanilide coupler, an acroylacetanilide coupler, a pivaloylacetanilide coupler, a naphthol coupler, a phenol coupler, a 5-pyrazolone coupler, a pyrazolobenzimidazole coupler; a cyanoacetylcumarone coupler, and the like.

As the magenta coupler, for instance, a 5-pyrazolone coupler, a cyanoacetylcumarone coupler, and an indazolone coupler are generally used. Particularly useful magenta couplers which can be used in this invention are those represented by the following general formula

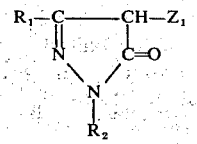

(I)

wherein $R_1$ represents a primary, secondary or tertiary alkyl group (e.g., having 1 to 18 carbon atoms such as methyl, propyl, n-butyl, t-butyl, hexyl, 2-hydroxyethyl, and 2-phenylethyl groups), an aryl group, an alkoxy group (e.g., methoxy, ethoxy, and benzyloxy groups), an aryloxy group (e.g., a phenoxy group), a heterocyclic ring (e.g., quinolinyl, pyridyl, piperidyl, benzofuranyl, and oxazolyl groups), an amino group (e.g., methylamino, diethylamino, phenylamino, tolylamino, 4-(3-sulfobenzamino)anilino, 2-chloro-5-acylaminoanilino, 2-chloro-5-alkoxy-carbonylanilino, and 2-tolylfluoromethylphenylamino groups), a carbonamido group (e.g., alkylcarbonamido, arylcarbonamido, and heterocyclic carbonamido groups), sulfonamido (e.g., alkylsulfonamido, aryl sulfonamido, and heterocyclic sulfonamido group), a ureido group (e.g., alkylureido, arylureido, and heterocyclic ureido groups), etc.; $R_2$ represents an aryl group (e.g., naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trichloromethylphenyl, and 3,5-dibromophenyl groups), a heterocyclic group (e.g., benzyfuranyl, naphthoxazolyl, and quinolinyl groups), a primary, secondary, or tertiary alkyl group (e.g., having 1 to 18 carbon atoms such as, methyl, ethyl, t-butyl, and benzyl group), etc.; and $Z_1$ represents a hydrogen atom or a group releasable at color development as described in U.S. Pat. Nos. 3,419,391, 3,252,924, 3,311,476 or 3,227,550 or U.S. patent application Ser. No. 454,525, filed Mar. 25, 1974, such as a thiocyano group, an acyloxy group, an aryloxy group, an alkoxy group, an alkoxycarbonyloxy group, an aryloxycarbonyloxy group, a di-substituted amino group (e.g., suchc as those disclosed in U.S. patent application Ser. No. 471,639, filed May 20, 1974 (attorneys Docket No. Q-1692, corresponding to Japanese Pat. Application No. 56050/1973), an arylazo group or a heterocyclic azo group, etc., or a group described in U.S. Pat. Nos. 3,148,062, 3,227,554, 3,615,506 or 3,701,783 such as an aryl monothio group (e.g., 2-aminophenyl thio, 2-hydroxycarbonylphenylthio and the like), a heterocyclic monothio group (e.g., tetrazolyl group, triazinyl group, triazolyl group, oxazolyl group, oxadiazolyl group, diazolyl group, thiazyl group, thiadiazolyl group and the like), or a heterocyclic imido group (e.g., 1-triazolyl group, 1-imidazolyl group, 2-benzotriazolyl group and the like).

When the magenta coupler represented by general formula (I) is an interlayer color correction magenta coupler, $Z_1$ is a residue which releases a development inhibitor at development, such as an arylmonothio group (e.g., 2-aminophenylthio and 2-hydroxycarbonylphenylthio groups), a heterocyclic monothio group (e.g., tetrazolyl, triazinyl, triazolyl, oxazolyl, oxadiazolyl, diazolyl, thiazyl, and thiadiazolyl groups) a heterocyclic imido group (e.g., 1-benzotriazolyl, 1-indazotriazolyl groups), etc. These groups are described in, for example, U.S. Pat. Nos. 3,148,062; 3,227,554; 3,615,506; and 3,701,783.

As the yellow couplers used in this invention, there are, for example, an open-chain acylacetanilide coupler (e.g., a pivaloylacetanilide coupler and an aroylacetanilide coupler), an open-chain acylacetonitrile coupler, etc. Particularly useful yellow couplers which can be used in this invention are couplers represented by the following general formula

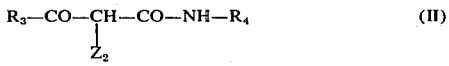

(II)

wherein $R_3$ represents a primary alkyl group, a secondary alkyl group, or a tertiary alkyl group (e.g., having 1 to 18 carbon atoms such as t-butyl, 1,1-dimethylpropyl, 1,1-dimethyl-1-phenylthiomethyl, 1,1-dimethyl-1-methoxyphenoxymethyl groups), or an aryl group (e.g., phenyl, alkylphenyl such as 3-methylphenyl, 3-octadecylphenyl, etc., alkoxyphenyl, halophenyl, 2-halo-5-alkamidophenyl, 2-chloro-5-[α-(2,4-di-t-amylphenoxy)-butyramids]phenyl, 2-methoxy-5-alkamidophenyl, 2-chloro-5-sulfonalkamidophenyl, and 2-chloro-5-sulfonamidophenyl groups); $R_4$ represents an aryl group (e.g., 2-chlorophenyl, 2-halo-5-alkamidophenyl, 2-chloro-5-[α-(2,4-di-t-amylphenoxy)acetamido]-phenyl, 2-chloro-5-(4-methylphenylsulfonamido)phenyl, and 2-methoxy-5-(2,4-di-t-amylphenoxy)acetamidophenyl groups), and $Z_2$ represents a hydrogen atom or a group which is splitable at color development such as a halogen atom, and particularly a fluorine atom, an acyloxy group, an aryloxy group, a heterocyclic aromatic carbonyloxy group, an arylsulfoxy group, a dioxoimido group such as a phthalimido group, a dioxyimidazolidinyl group, a dioxyoxazolidinyl group, and a imidazolyl group, or a dioxythiazolidinyl group and the like, as described in U.S. Pat. Nos. 3,227,550, 3,253,924, 3,277,155, 3,265,506, 3,408,194 and 3,415,652, French Pat. No. 1,411,384, British Pat. Nos. 944,490, 1,040,710, and 1,118,028, and German Pat. Publications (OLS) 2,057,941, 2,163,812, 2,213,461 and 2,219,917.

When the yellow coupler is an interlayer color correction yellow coupler, $Z_2$ is a residue which releases a development inhibitor at development, such as, for example, an arylmonothio group (e.g., a phenylthio group or a 2-carboxyphenylthio group), a heterocyclic thio group, a 1-benzotriazole group, a 1-benzodiazole group, etc. These groups are described in the specification of U.S. patent application Ser. No. 454,525, filed Mar. 25, 1974.

As the cyan coupler used in this invention, there are a naphthol coupler and a phenol coupler. Particularly useful cyan couplers which can be used in this invention are couplers represented by the following general formulas:

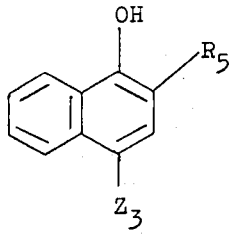

(III)

and

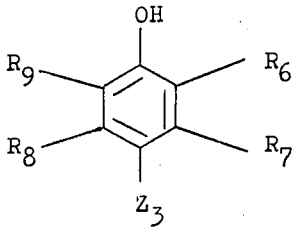

(IV)

wherein $R_5$ represents a substituent used for cyan couplers, such as, for example, a carbamyl group (e.g., alkylcarbamyl, arylcarbamyl such as phenylcarbamyl, and heterocyclic carbamyl such as benzothiazolylcarbamyl groups), a sulfamyl group (e.g., alkylsulfamyl, arylsulfamyl such as phenylsulfamyl, heterocyclic sulfamyl groups), an alkoxycarbonyl group, an aryloxycarbonyl group, etc.; $R_6$ represents an alkyl group (e.g., having 1 to 18 carbon atoms), an aryl group, a heterocyclic group, an amino group (e.g., amino, alkylamino, and arylamino groups), a carbonamido group (e.g., alkylcarbonamido and arylcarbonamido groups), a sulfonamido group, a sulfamyl group (e.g., alkylsulfamyl and arylsulfamyl groups), or a carbamyl group; $R_7$, $R_8$ and $R_9$ each represents those groups given for $R_6$ and, in addition, represents a halogen atom or an alkoxy group; and $Z_3$ represents a hydrogen atom or a group which is splitable at color development such as a halogen atom, a thiocyano group, an imino group, a cycloimido group (e.g., maleimido, succinimido, 1,2-dicarboximido and the like), an arylazo group or a heterocyclic azo group.

When the cyan coupler is an interlayer color correction cyan coupler, $Z_3$ represents the releasing group or the residue described for $Z_1$ or $Z_2$.

It is known that a group including a hydrophobic residue having about 8 to 32 carbon atoms can be introduced into the coupler molecule to render the coupler non-diffusible. The residue is called a ballast group. The ballast group can be connected to the structure of the coupler directly or through an imino bond, an ether bond, a carbonamido bond, a sulfonamido bond, an ureido bond, an ester bond, an imido bond, a carbamoyl bond, a sulfamoyl bond, etc.

Specific examples of the ballast groups of the couplers used in this invention are shown below, whereby the specific chemical structures of the couplers represented by general formulas (I), (II), (III) and (IV) will be understood.

1. Alkyl groups and alkenyl groups: For example, $CH_2—CH—(C_2H_5)_2$, $—C_{12}H_{25}$, and $—C_{17}H_{33}$.

2. Alkoxyalkyl groups: For example, $—(CH_2)_3—O—(CH_2)_7CH_3$, $$—(CH_2)_3OCH_2—\underset{\underset{C_2H_5}{|}}{CH}—(CH_2)_3—CH_3,$$

etc., as described in the specification of Japanese Pat. Publication No. 27563/1964.

3. Alkylaryl groups: For example,

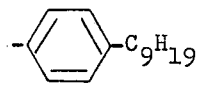

and

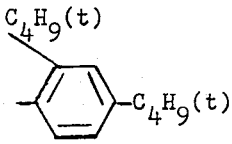

4. Alkylaryloxyalkyl groups: For example,

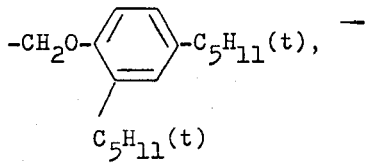

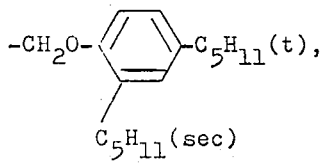

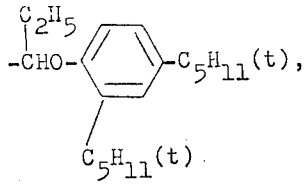

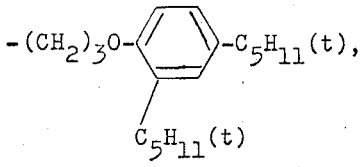

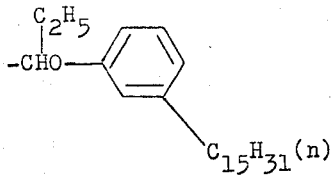

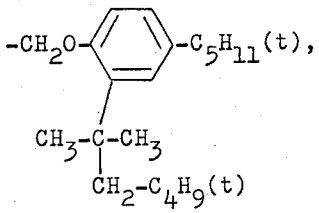

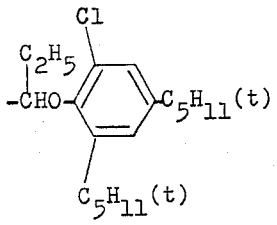

5. Acylamidoalkyl groups: For example, the following groups as described in U.S. Pat. Nos. 3,337,344 and 3,418,129;

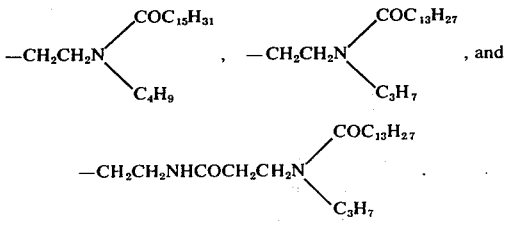

6. Alkoxyaryl groups and aryloxyaryl groups: For example,

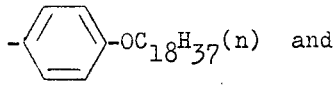

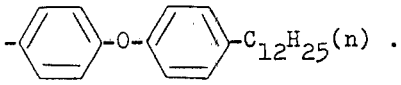

7. Residues having an alkyl or alkenyl long chain aliphatic group and a carboxyl or sulfo water-solubilizing group together: For example,

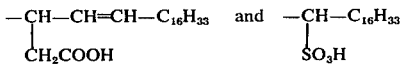

8. Alkyl groups substituted with an ester group: For example,

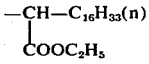

9. Alkyl groups substituted with an aryl group or a heterocyclic group: For example,

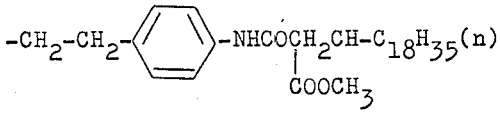

and

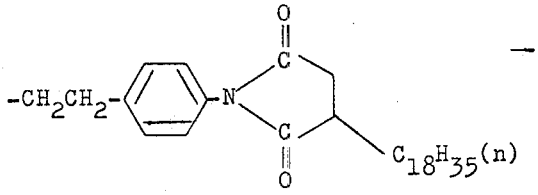

10. Aryl groups substituted with aryloxyalkoxycarbonyl group: For example,

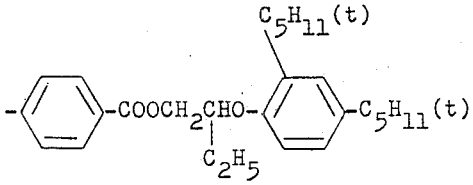

While not desiring to be bound the color reproduction system in multilayer color photographic materials is considered to be constructed by, as one fundamental element, a combination of the photosensitive characteristics of the photosensitive wave length region of an original to light and the spectral sensitivity distribution thereof and the spectral absorption characteristics of the dye images formed corresponding thereto.

The term "photosensitive emulsion layer unit" as used in describing this invention designates a silver halide emulsion layer or a group of silver halide photographic emulsion layers having a sensitivity to a specific wave length region and containing a coupler forming a dye image having a spectral absorption corresponding thereto. For improving the deficiencies caused by using an interlayer color correction coupler, in particular, a so-called "DIR coupler", such as a reduction in coupling density and a reduction in gradation, it is preferable that the photosensitive emulsion layer unit be composed of two or more unit emulsion layers as described in U.S. patent application Ser. No. 454,525, filed Mar. 25, 1974. Furthermore, an intermediate layer (ML) or a filter layer (FL) can be interposed between the unit emulsion layers. For example, in the case of a multilayer color photographic material having three photosensitive emulsion layer units, the green-sensitive emulsion layer unit has a sensitivity in a wave length region of from about 500 nm to about 600 nm and the dye image formed by the coupler used in the green-sensitive emulsion layer unit has a spectral absorption peak in a region of from about 560 nm to about 540 nm. Thus, the optical density in the region of from about 560 nm to about 590 nm tends to be insufficient but if a coupler forming a dye having a absorption peak in a longer wave length region is used for compensation, the undesired absorption in a longer wave length side increases to render the color of the red system turbid. On the other hand, the optical density in the region of from about 540 to about 500 nm is insufficient and if a coupler forming a dye having the absorption peak in a shorter wave length region is used for compensation, the desired absorption in a shorter wave length side increases to reduce the depth of color of the red system. Thus, by providing an interlayer interimage effect to the red-sensitive emulsion layer unit using a magenta coupler capable of forming a dye which has an absorption peak in a longer wave length side and which is lacking in optical density in a shorter wave length side and an interlayer color correction yellow coupler, excellent color reproducibility in red system can be obtained. On the other hand, by providing a sufficient interlayer interimage effect to the red-sensitive emulsion layer unit and a strong interlayer interimage effect to the blue-sensitive emulsion layer unit using a magenta coupler which has an absorption peak in a comparatively shorter wave length side and which is lacking in optical density in a longer wave length side and an interlayer color correction cyan coupler, an excellent color reproducibility of colors in a red-vermilion system can be obtained. Also, by providing a strong interlayer interimage effect to the green-sensitive emulsion layer unit using a cyan coupler and an interlayer color correction yellow coupler in the red-sensitive emulsion layer unit, an excellent color reproducibility of colors in a green-fresh green system can be obtained. Furthermore, by providing a strong interlayer interimage effect to the green-sensitive emulsion layer unit using a yellow coupler and an interlayer color correction cyan coupler in the blue-sensitive emulsion layer unit, the color saturation in a yellow system can be improved. Moreover, an emulsion layer containing a silver halide emulsion panchromatically and spectrally sensitized and an interlayer color correction cyan coupler or an interlayer color correction yellow coupler can be interposed between the red-sensitive emulsion layer unit and the green-sensitive emulsion layer unit.

Because the interlayer color correction yellow coupler and the interlayer color correction cyan coupler used in this invention can be produced easily on an industrial scale and are stable chemically, color photographic materials having high storability can be obtained with low cost.

The excellent effects of the present invention can be attained with, particularly, the following multilayer configurations.

An interlayer interimage effect or color correction effect tends to appear between adjacent emulsion layers. Thus, particularly preferred multilayer configurations of the multilayer color photographic materials of this invention are illustrated in the accompanying drawings.

That is to say, in an embodiment as illustrated in FIG. 1 of the accompanying drawings, a red-sensitive emulsion layer unit (RL), a green-sensitive emulsion layer unit (GL), and a blue-sensitive emulsion layer unit (BL) are formed on a support in this order.

Figure 2:
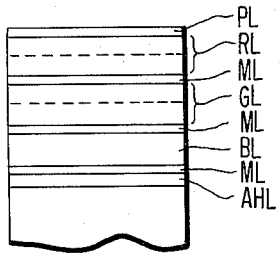

In a second embodiment of this invention as illustrated in FIG. 2, a blue-sensitive emulsion layer unit (BL), a green-sensitive emulsion layer unit (GL), and a red-sensitive emulsion layer unit (RL) are formed on a support in this order.

Figure 3:
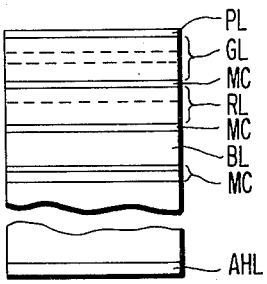
Figure 4:
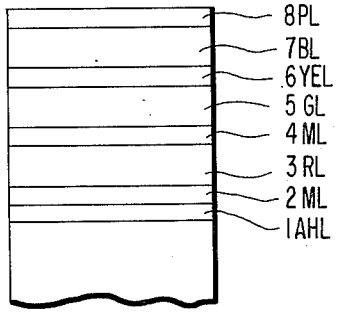

In a third embodiment of this invention as illustrated in FIG. 3, a blue-sensitive emulsion layer unit (BL), a red-sensitive emulsion layer unit (RL), and a green-sensitive emulsion layer unit (GL) are formed on a support in this order. A protective layer (PL), an antihalation layer (AHL), a filter layer (FL), and intermediate layers (ML) can be formed on, adjacent to, or between the photosensitive emulsion layers or photosensitive emulsion layer units or the multilayer color photographic material of this invention. Also, a silver halide colloid layer can be formed on the upper layer of the photosensitive emulsion layer unit, on the lowermost layer, or on the back side of the support. By the aforesaid configurations, the uniformity and the stability of the color development of the multilayer color photographic material can be improved.

Specific examples of couplers which can be used in this invention are illustrated below although the couplers used in this invention are not limited to these couplers only.

Yellow Couplers

1. α-(4-Methoxy-benzoyl)-2-chloro-5-[α-(2,4-di-tert-amylphenoxy)butyramido]acetanilide.
2. α-{3-[α-(2,4-Di-tert-amylphenoxy)butyramido]-benzoyl}-2-methoxyacetanilide.
3. α-Acetoxy-α-3-[α-(2,4-di-tert-amylphenoxy)-butyramido]-benzoyl-2-methoxyacetanilide.
4. N-(4-Anisoylacetamidobenzenesulfonyl)-N-benzyl-N-toluidine.
5. α-(2,4-Dioxo-5,5-dimethyloxazolizinyl)-α-pivaloyl-2-chloro-5-[α-(2,4-di-tert-amylphenoxy)-butyramido]acetanilide.
6. α-(4-Carboxyphenoxy)-α-pivaloyl-2-chloro-5-[α-(2,4-di-tert-amylphenoxy)butyramido]acetanilide.
7. α-[3-(1-Benzyl-2,4-dioxo)hydantoin]-α-pivaloyl-2-chloro-5-[α-(2,4-di-tert-amylphenoxy)-butyramido]acetanilide.

Magenta Couplers 8. 1-(2,4,6-Trichlorphenyl)-3-[2,4-di-tert-amylphenoxyacetamido)benzamido]-5-pyrazolone.

9. 1-(2,4,6-Trichlorophenyl)-3-{3-[α-(2,4-di-tert-amulphenoxy)acetamido]benzamido}-4-acetoxy-5-pyrazolone.

10. 1-(2,4,6-Trichlorophenyl)-3-tridecylamido-4-(4-methoxyphenyl)azo-5-pyrazolone.

11. 1-(2,4,6-Trichlorophenyl)-3-(2-chloro-5-tetradecyloxycarbonyl)anilino-5-pyrazolone.

12. 1-(2,4-Di-chloro-6-methoxyphenyl)-3-[(2-chloro-5-tridecanolyamino)anilino]-4-benzyloxycarbonyloxy-5-pyrazolone.

13. 1-(2,6-Dichloro-4-methoxyphenyl)-3-{3-[2,4-di-tert-amylphenoxy]acetamido}-benzamido-4-(3-ethyl-4-methyl-piperidino)-5-pyrazolone.

14. 1-(2,4,6-Trichlorophenyl)-3-(2-chloro-5-tetradecanoylaminoaniline)-4-(3-methyl-4-hydroxyphenylazo)-5-pyrazolone.

15. 1-Hydroxy-N-[γ-(2,4-di-tert-amylphenoxybutyl)]-2-naphthamide.

16. 1-Hydroxy-N-[γ-(2,4-di-tert-amylphenoxypropyl)]-2-naphthamide.

17. 1-Hydroxy-4-[2-(2-hexyldecyloxycarbonyl)-phenylazo]-2-N-(1-naphthyl)-naphthamide.

18. 5-Methyl-4,6-dichloro-2-[α-(3-n-pentadecylphenoxy)-butyramido]phenol.

Interlayer Color Correction Coupler

19. α-Benzoyl-α-(2-benzothiazolylthio)-4-[N-(γ-phenylpropyl)-N-(4-tolyl)sulfamyl]acetanilide.

20. α-Pivaloyl-α-(5- or 6-bromo-1-benztriazolyl)-2-chloro-5-[γ-(2,4-di-tert-amylphenoxy)-butyramido]acetanilide.

21. α-(4-Stearyloxybenzoyl)-α-(5- or 6-bromo-1-benztriazolyl)-5-methoxyacetanilide.

22. 1-Hydroxy-N-{2-methoxy-4-[δ-(2,4-di-tert-amylphenoxy)butyloxycarbonyl]phenyl}-4-(1-phenyl-2-tetrazolylthio)-naphthamide.

23. 1-Hydroxy-N-(2-chloro-5-hexadecyloxycarbonylphenyl)-4-(1-phenyl-2-tetrazolylthio)naphthamide.

24. 1-Hydroxy-4-iodo-N-dodecyl-2-naphthamide.

25. 5-Methoxy-2-[α-(3-pentadecylphenoxy)-butyramido]-4-(1-phenyl-5-tetrazolylthio)phenol.

26. 1-(2,4,6-Trichlorophenyl)-3-{4-[α-(2,4,di-tertamylphenoxy)butyramido]anilino}-4-(1-phenyl-5-tetrazolylthio)-5-pyrazolone.

27. 1-Benzyl-3-[2-chloro-3-(tetradecanamido)anilino]-4-(5- or 6-methyl-1-benztriazolyl)-5-pyrazolone.

28. 1- 4-[α-(2,4-Di-tert-amylphenoxy)acetamido]-phenyl-3-ethoxy-4-(4- or 6-bromo-1-benztriazolyl)-5-pyrazolone.

The couplers used in this invention can be prepared by well known methods known in the art and the methods described in U.S. patent application Ser. No. 454,525, filed Mar. 25, 1974.

The objects of this invention are not attained by conventional techniques but can be attained very easily for industrial purpose using the techniques of this invention as described in the specification.

British Pat. No. 1,261,061 teaches a method of using a dispersion of oil drops having a coupler and a DIR couplers dissolved therein. However, the coupler used in this British Patent forms, by the coupling reaction with the oxidation product of a primary aromatic amine color developing agent, a dye having the same color as the dye formed by the DIR coupler by the coupling reaction with the oxidation product of the color developing agent and hence the invention disclosed in the British patent is different from the present invention.

British Pat. No. 1,269,073 and British Pat. No. 1,269,075 teach photographic emulsions in which DIR couplers and other couplers are used together but the present invention is not suggest. That is to say, the examples of these patents show only couplers which form the dyes having the same color as the dyes formed from the DIR couplers by the coupling reaction with the oxidation product of a primary aromatic amine color developing agent. Therefore, the inventions of these British patents are utterly different from the concept of the present invention.

U.S. Pat. No. 3,620,745 teaches that it is useful to constitute the photosensitive emulsion layer unit of a color photographic material by two photographic emulsion layers which form, respectively, two clearly distinguishable dye images and to incorporate a DIR coupler in the second emulsion layer of the emulsion layer unit. However, this U.S. patent does not suggest the concept of the present invention. That is to say, since the present invention corresponds to the use of a DIR coupler which can form a dye image having a color similar to or substantially the same as the color of the dye formed from the coupler contained in the first emulsion layer of the color photographic material taught by the U.S. patent, it can be said that the present invention is contrary to the purpose of the U.S. Pat. No. 3,620,745. Thus, the present invention is clearly distinguished from the invention of U.S. Pat. No. 3,620,745.

Also, U.S. Pat. No. 3,620,747 teaches a specific color photographic material having particularly broad exposure latitude, in which the first silver halide photographic emulsion layer contains a DIR coupler as a coupler and the second high-sensitive silver halide photographic emulsion layer contains a coupler. As described in U.S. Pat. No. 3,620,747, a color photographic material having a wide exposure latitude by employing a two emulsion layer configuration of a low-sensitive silver halide emulsion layer and a high-sensitive silver halide emulsion layer is well known and has been generally used. U.S. Pat. No. 3,620,747 does not suggest the present invention. That is to say, the examples of this U.S. patent teach that it is useful to use, as the DIR coupler and the coupler, the compounds capable of giving the dyes having substantially same color, i.e., cyan color, and thus it can be said that this teaching does not suggest the attainment of the objects of this invention. Therefore, the present invention is also clearly distinguished from the invention of U.S. Pat. No. 3,620,747.

The couplers used in this invention can be generally classified into a Fisher type coupler having a water-solubilizing group, such as a carboxyl group, a hydroxyl group, and a sulfo group and a hydrophobic coupler. The couplers in this invention can be added to gelatino silver halide emulsions or hydrophilic colloids using the conventional technique of adding or dispersing the couplers in silver halide emulsions or hydrophilic colloids. A suitable total amount of coupler which can be used ranges from about 0.1 to 100 mol per mol of silver halide and the interlayer correction coupler is generally used in an amount of about 1 to 50% by weight, preferably 5 to 30% by weight based on the total weight of the couplers present. In dispersing the couplers, for example, a method of dispersing a coupler as a mixture thereof with a high boiling organic solvent (e.g., above 170°C) such as dibutyl phthalate, tricresyl phosphate, a wax, a higher fatty acid, and an ester of the higher fatty acid; the methods as described in U.S. Pat. Nos. 2,304,939 and 2,322,027; a method of dispersing a coupler as a mixture thereof with a low boiling organic solvent (e.g., below 170°C) or a water-soluble organic solvent such as ethyl acetate, butyl acetate, tetrahydrofuran, ethanol, cyclohexanol, acetone, cyclohexanone, etc.; a method of dispersing a coupler using a high boiling organic solvent; the methods as described in U.S. Pat. Nos. 2,801,170; 2,801,171 and 2,949,360; a method of dispersing a coupler, when the coupler itself has a sufficiently low melting point lower than, e.g., 75°C, alone or together with other couplers to be used therewith, such as a colored coupler and/or an uncolored coupler; the methods as described in, for instance, German Pat. No. 1,143,707; etc., can be employed. It is preferable, in this case, the amount of the coupler used is about 0.2 to about 0.01 mol to 1 mol of silver halide in the silver halide emulsion to which the coupler is added.

In dispersing the coupler in a silver halide emulsion, a dispersing agent is usually used and examples of such a dispersing agent are an anionic surface active agent (e.g., sodium alkylbenzenesulfonate, sodium dioctylsulfosuccinate, sodium dodecylsulfate, sodium alkylnaphthalenesulfonate, and a Fisher type coupler), an amphoteric surface active agent (e.g., N-tetradecyl-N,N-dipolyethylene-$\alpha$-betanine, etc.) and a nonionic surface active agent (e.g., sorbitan monolaurate, etc.).

Examples of silver halide emulsions which can be used in this invention are photographic emulsions containing silver bromide, silver iodide, silver chloride, or a mixed silver halide such as silver chlorobromide, silver iodobromide, silver chloroiodobromide, etc., but particularly preferable results are obtained when at least one photographic emulsion layer of the color photographic material contains a silver chloroiodide emulsion, a silver iodobromide emulsion, or a silver chloroiodobromide emulsion each containing about 1 to 10 mol percent iodine.

Suitable hydrophilic colloids which can be used in this invention are gelatin, a cellulose derivative, an alginate, a hydrophilic synthetic polymer such as polyvinyl alcohol, polyvinyl pyrrolidone, polystyrene sulfonate, etc. Also, for improving the dimensional stability of the layer of the hydrophilic colloid, a plasticizer or a polymer latex such as polymethyl methacrylate and polyethyl acrylate can be used.

The silver halide emulsions used in this invention may be chemically sensitized by an ordinary manner. For instance, the gold sensitization methods as described in U.S. Pat. Nos. 2,399,083; 2,597,856 and 2,597,915; the reduction sensitization methods as described in U.S. Pat. Nos. 2,487,850 and 2,521,925; the sulfur sensitization methods as described in U.S. Pat. Nos. 1,623,499 and 2,410,689; the sensitizing methods using metal ions other than silver as described in U.S. Pat. Nos. 2,448,060, 2,566,245 and 2,566,263; or a combination of these methods can be applied depending on the end-use purpose. Furthermore, the silver halide photographic emulsions used in this invention can be optically sensitized using sensitizing dyes conventionally used for the spectral sensitization of color photographic materials. Typical sensitizing dyes include the cyanines, merocyanines, carbocyanines, etc., such as anhydro-9-methyl-5,5'-dimethyl-3,3'-di(3-sulfopropyl)-benzselenacarbocyanine, 5,5'-dichloro-9-ethyl-di(2-hydroxyethyl)thiacarbocyanine bromide, anhydro-5,5'-diphenyl-9-ethyl-3,3'-di(2-sulfoethyl)-benzoxazolocarbocyanine hydroxide, etc. Other suitable sensitizing dyes are described in U.S. Pat. Nos. 2,493,748; 2,519,001; 2,977,229; 3,480,434; 3,672,897; 3,703,377; 2,688,545; 2,912,329; 3,397,060; 3,615,635; 3,628,964; British Pat. Nos. 1,195,302; 1,242,588; 1,293,862, West German Pat. OLS Nos. 2,030,326; 2,121,780; Japanese Pat. Publication Nos. 4936/1968; 14030/1969; U.S. Pat. Nos. 3,511,664; 3,522,052; 3,527,641; 3,615,613; 3,615,632; 3,617,295; 3,635,721; 3,694,217; British Pat. Nos. 1,137,580; 1,216,203, Japanese Pat. Publication No. 10773/1968, etc. These materials can be used alone or as a combination thereof.

Moreover, the silver halide emulsions used in this invention can contain a stabilizer such as, for example, a 4-hydroxy-1,3,3*a*,7-tetraazaindene derivative, etc.; an antifoggant such as, for instance, a mercapto compound, a benzotriazole derivative, etc.; a coating aid such as, for instance, saponin, sodium alkylbenzenesulfonate, etc.; a hardening agent such as formaldehyde, mucobromic acid, etc.; and a wetting agent and a sensitizer, for example the onium derivatives such as the quaternary ammonium salts as described in U.S. Pat. Nos. 2,271,623; 2,288,226; and 2,334,864 and the polyalkylene oxide derivatives as described in U.S. Pat. Nos. 2,708,162; 2,521,832; 2,533,990; 3,210,191; and 3,158,484. Also, as a filter layer of the multilayer color photographic material of this invention, a layer containing an irradiation preventing dye or a colored layer containing a hydrophobic dye can be formed.

The silver halide emulsion can be hardened in a conventional manner. Examples of hardening agents which can be employed for this purpose are aldehyde compounds such as formaldehyde, glutaraldehyde, etc.; ketone compounds such as diacetyl, cyclopentandione, etc.; reactive halogen containing compounds such as bis-(2-chloroethylurea) and 2-hydroxy-4,6-dichloro-1,3,5-triazine, as disclosed in U.S. Pat. Nos. 3,288,775 and 2,732,303, British Pat. Nos. 974,723 and 1,167,207; compounds having a reactive olefinic group such as divinylsulfone, 5-acetyl-1,3-diacryloylhexahydro-1,3,5-triazine, etc., as described in U.S. Pat. Nos. 3,635,718 and 3,232,763 and British Pat. No. 994,869; the N-methyloyl compounds such as N-hydroxymethylphthalimide, etc., as described in U.S. Pat. Nos. 2,732,316 and 2,586,168; the isocyanates as described in U.S. Pat. No. 3,103,437; the organic carboxylic acid or sulfonic acid derivatives as described in U.S. Pat. Nos. 2,725,294 and 2,725,295; the carbodiimide compounds as described in U.S. Pat. No. 3,100,704; the epoxy compounds as described in U.S. Pat. No. 3,091,537; the isooxazole compounds as described in U.S. Pat. Nos. 3,321,313 and 3,543,292; halocarboxyaldehydes such as mucochloric acid; dioxane derivatives such as dihydroxydioxane, dichlorodioxane, etc.; and inorganic hardening agents such as chromium alum, zirconium sulfate, etc.

Also, precursors such as, for instance, an alkali metal bisulfitealdehyde addition product, a methylol derivative of hydantoin, and a primary aliphatic nitro alcohol can be used instead of the above-described compounds as the hardening agent for the photographic emulsions.

The silver halide emulsion layers of this invention are coated on a support. Suitable supports which can be used are a cellulose acetate film, a polyethylene terephthalate film, a glass plate, a baryta-coated paper, a resin-coated paper, and a synthetic paper. A suitable coating amount of silver is about 0.1 to 20 g (as silver) per square meter.

In the step of processing the color photographic material of this invention for forming dye images, a developer capable of reducing silver halide grains to silver is used. In the case of black and white development, a developer containing, as a developing agent, a polyhydroxybenzene, a N-alkylaminophenol, a 1-phenyl-3-pyrazolidone, or a mixture of these developing agents can be used. Examples of polyhydroxybenzenes which can be used in the developer are hydroquinone, pyrocatechol, pyrogallol, etc.; examples of the N-alkylaminophenols are N-methylaminophenyl, N-ethylaminophenol, etc.; and examples of the 1-phenyl-3-pyrazolidones are 1-phenyl-3-pyrazolidone, 1-phenyl-4,4-dimethyl-3-pyrazolidone, etc. In the case of color development, a developer containing, as the developing agent, 4-amino-N,N-diethylaniline, 4-amino-3-methyl-N-methyl-N-($\beta$-methylsulfonamidoethyl)aniline, 4-amino-3-methyl-N-ethyl-N-($\beta$-hydroxyethyl-)aniline, 4-hydroxyaniline, 4-hydroxy-2,6-dibromoaniline, etc., can be used.

The multilayer color photographic material of this invention can be processed at an ordinary temperature, i.e., at about 20° to 30°C but may be processed at a higher temperature, i.e., at about 30 to 60°C or higher.

Suitable processes for processing the multilayer color photographic materials of this invention are described in, for instance, the specifications of British Pat. No. 1,203,316, U.S. Pat. No. 3,695,883 and U.S. patent application Ser. No. 234,163, filed Mar. 13, 1972, and Ser. No. 240,287, filed Mar. 31, 1972; in H. Gordon, *The British Journal of Photography*, p. 558 et seq, Nov. 15, 1954, on *The British Journal of Photography*, page 440 et seq, Sept. 9, 1955, and *The British Journal of Photography*, p. 2 et seq, Jan. 6, 1956, in S. Horwitz *The British Journal of Photography*, p. 212, et seq, Apr. 22, 1960, in E. Gehre *The British Journal of Photography*, p. 396 et seq., Mar. 4, 1960 in ibid., page 96 et seq. May 7, 1965, in J. Meech *The British Jurnal of Photography*, page 182 et seq., Apr. 3, 1959, and in the specification of German Offenlegungsschrift (OLS) No. 2,238,051.

The following examples are given to illustrate the present invention in greater detail and the examples are not intended to be interpreted as limiting the invention in any way. Unless otherwise indicated, all parts, percents, ratios and the like are by weight.

EXAMPLE 1

Sample A was prepared by coating on a transparent cellulose triacetate film support the following layers as illustrated in FIG. 3 of the accompanying drawings.

The compositions of the coating compositions used for forming the layers of Sample A and the manner of preparing the coating compositions and forming the photographic layers were as follows:

First Layer (backing layer): Antihalation Layer

The coating composition for the layer was prepared by dispersing black colloidal silver in a gelatin solution and coated so as to provide 0.45 g Ag per m$^2$.

Second Layer: Intermediate Layer

The coating composition was prepared by dissolving 50 g of 2,5-di-t-octylhydroquinone in a mixture of 100 ml of tricresyl phosphate and 200 ml of ethyl succinate, dispersing the solution in 1 kg of a 10% aqueous gelatin solution using 4 g of sodium dodecylbenzenesulfonate to provide Emulsion I, and mixing 100 g of Emulsion I with 1 kg of a 10% aqueous gelatin solution and coated in a dry thickness of 0.7 $\mu$.

Third Layer: Red-Sensitive Emulsion Layer 1 kg of a silver iodobromide emulsion (0.6 mol silver and 6 mol% iodine) prepared in a conventional manner and spectrally sensitized using $4 \times 10^{-5}$ mol of Sensitizing Dye I and $1 \times 10^{-4}$ mol of Sensitizing Dye II was mixed with 500 g of Emulsion II prepared by dissolving 87 g of Coupler (15) and 13 g of Coupler (17) in a mixture of 100 ml of tricresyl phosphate and 200 ml of ethyl succinate and dispersing the solution in an aqueous gelatin solution as in the case of preparing Emulsion I and then the coating composition thus prepared was coated on the intermediate layer at a coverage of 1.6 g silver per square meter.

Fourth Layer: Intermediate Layer

Same as the second layer.

Fifth Layer: Green-Sensitive Emulsion Layer 1 kg of a silver iodobromide (having the same composition as the silver halide emulsion used for forming the third layer) spectrally sensitized using $2 \times 10^{-4}$ mol of Sensitizing Dye III and $6 \times 10^{-5}$ mol of Sensitizing Dye IV was mixed with 330 g of Emulsion III of 84 g of Coupler (8) and 16 g of coupler (14) prepared as in the case of preparing Emulsion II and the coating composition thus prepared was coated on the fourth layer at a coverage of 1.8 g silver per square meter.

Sixth Layer: Yellow Filter Layer

The coating composition was prepared by adding yellow colloidal silver and Emulsion I to an aqueous gelatin solution and coated in an amount of 1.01 g Ag/m$^2$.

Seventh Layer: Blue-Sensitive Emulsion Layer 1 kg of a silver iodobromide (0.7 mol silver and 7 mol% iodine) was mixed with 400 g of Emulsion IV of Coupler (1) prepared as in the case of preparing Emulsion II and the coating composition thus prepared was coated at a coverage of 1.1 g of silver per square meter.

Eighth Layer: Protective Layer

A coating composition containing an aqueous gelatin solution.

To each coating composition, a suitable amount of a gelatin hardening agent (sodium salt of 2-hydroxy-4,6-dichloro-s-triazine), a wetting agent and surface active agent (saponin), and a thickener (potassium salt of polystyrene sulfonic acid) were added in addition to the aforesaid components.

The materials used for preparing Sample A were as follows:

Coupler (15): 1-Hydroxy-N-[$\gamma$-(2,4-di-t-amylphenoxy)butyl]-2-naphthamide.

Coupler (17): 1-Hydroxy-4-[2-(2-hexyldecyloxycarbonyl)-phenylazo]-2-[N-(1-naphthyl)].

Coupler (8): 1-(2,4,6-Trichlorophenyl)-3-{3-[α-(2,4-di-t-amylphenoxy)acetamido]benzamido}-5-pyrazolone.

Coupler (14): 1-(2,4,6-Trichlorophenyl)-3-(2-chloro-5-tetradecanoylaminoanilino)-4-(3-methyl-4-hydroxyphenylazo-5-pyrazolone.

Coupler (1): α-(4-Methoxy-benzoyl)-2-chloro-5-[α-(2,4-di-t-amylphenoxy)butylamido]acetanilide.

Sensitizing Dye I: Anhydro-5,5′-dichloro-3,3′-disulfopropyl-9-ethyl-thiacarbocyanine hydroxide pyridinium salt.

Sensitizing Dye II: Anhydro-9-ethyl-3,3′-di-(3-sulfopropyl)-4,5,4′,5′-di-benzothiacarbocyanine hydroxide triethylamine salt.

Sensitizing Dye III: Anhydro-9′-ethyl-5,5′-dichloro-3,3′-disulfopropyloxacarbocyanine sodium salt.

Sensitizing Dye IV: Anhydro-5,6,5′,6′-tetrachloro-1,1′-diethyl-3,3′-disulfopropoxyethoxyethylimidazolocarbocyanine hydroxide sodium salt.

Sample B was also prepared using the same procedure as in the case of preparing Sample A except that 320 g of Emulsion V of 80 g of Coupler (8), 20 g of Coupler (14) and 4 g of Coupler (20) was used in the fifth layer in place of Emulsion III.

Coupler (20): α-Pivaloyl-α-(5- or 6-bromobenztriazolyl)-2-chloro-5-[γ-(2,4-di-t-amylphenoxy)-butyramido]acetanilide.

Each of Sample A and Sample B was cut into a 35 mm color photographic negative film and the color photographic film was photographed in a still camera and processed in the following steps at 38°C.

| | | |
|---|---|---|
| 1. | Color Development | 3 minutes |
| 2. | Bleach | 6 minutes |
| 3. | Wash | 3 minutes |
| 4. | Fix | 6 minutes |
| 5. | Wash | 3 minutes |
| 6. | Stabilization | 3 minutes |

The composition of the processing solutions used in the above steps were as follows:

| Color Developer: | |
|---|---|
| Benzyl Alcohol | 5 ml |
| Sodium Hydroxide | 0.5 g |
| Diethylene Glycol | 3 ml |
| Sodium Hexametaphosphate | 2 g |
| Sodium Sulfite | 2 g |
| Potassium Bromide | 2 g |
| 4-Amino-3-methyl-N-ethyl-N-(β-hydroxyethyl)aniline Monosulfate | 5 g |
| Metaboric Acid | 0.5 g |
| Sodium Metaborate . $4H_2O$ | 77 g |
| Water to make | 1 liter |
| **Stop Solution:** | |
| Sodium Acetate | 30 g |
| Glacial Acetic Acid | 8 ml |
| Water to make | 1 liter. |
| **Hardening Solution:** | |
| Sodium Hexametaphosphate | 1 g |
| Borax . $5H_2O$ | 20 g |
| Formalin (37%) | 10 ml |
| Water to make | 1 liter. |
| **Bleach Solution:** | |
| Potassium Ferrocyanide | 8 g |
| Potassium Ferricyanide | 30 g |
| Potassium Bromide | 20 g |
| Borax . $5H_2O$ | 15 g |
| Boric Acid | 5 g |
| Ethylenediamine Tetraacetic Acid Disodium Salt . $2H_2O$ | 1 g |
| Water to make | 1 liter |
| **Fix Solution:** | |
| Sodium Hexametaphosphate | 1 g |
| Sodium Sulfite | 5 g |

-continued

| Color Developer: | |
|---|---|
| Sodium Thiosulfate | 150 g |
| Acetic Acid | 8 ml |
| Water to make | 1 liter. |

Using the procedure as shown above, Sample B which is an embodiment of this invention gave a color negative material having excellent color purity as compared with that of the color negative material obtained from Sample A.

EXAMPLE 2

Figure 5:
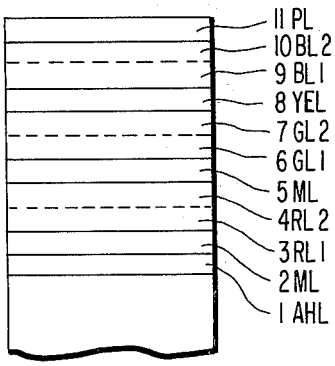

A multilayer color Photographic Material C having the layer structure as illustrated in FIG. 5 of the accompanying drawings was prepared using the manner as described in Example 1. In this embodiment, each of the red-sensitive emulsion layer unit, the green-sensitive emulsion layer unit, and the blue-sensitive emulsion layer unit was composed of two silver halide photographic emulsion layers as shown below:

First Layer: Antihalation Layer

Same as the first layer of Sample A.

Second Layer: Intermediate Layer

Same as the second layer of Sample A.

Third Layer: First Red-Sensitive Emulsion Layer

Silver Iodobromide Emulsion (8 mol% iodine) — silver coverage of 1.2 g/m².

Sensitizing Dye I (as shown in Example 1) — $6 \times 10^{-5}$ mol per mol of Ag.

Sensitizing Dye II (as shown in Example 1) — $1.5 \times 10^{-5}$ mol per mol of Ag.

Coupler (15) (as shown in Example 1) — 0.09 mol per mol of Ag.

Coupler (17) (as shown in Example 1) — 0.02 mol per mol of Ag.

Fourth Layer: Second Red-Sensitive Emulsion Layer

| | |
|---|---|
| Silver Iodobromide Emulsion (8 mol% iodine) | silver coverage of 1.1 g/m² |
| Sensitizing Dye I | $3 \times 10^{-5}$ mol per mol of Ag |
| Sensitizing Dye II | $1.2 \times 10^{-5}$ mol per mol of Ag |
| Coupler (15) | 0.02 mol per mol of Ag |
| Coupler (17) | 0.06 mol per mol of Ag |
| Coupler (21) | 0.08 mol per mol of Ag |

Fifth Layer: Intermediate Layer

Same as the fourth layer in Sample A.

Sixth Layer: First Green-Sensitive Emulsion Layer

| | |
|---|---|
| Silver Iodobromide Emulsion (8 mol% iodine) | silver coverage of 1.4 g/m² |
| Sensitizing Dye III (as shown in Example 1) | $3 \times 10^{-5}$ mol per mol of Ag |
| Sensitizing Dye IV (as shown in Example 1) | $1 \times 10^{-5}$ mol per mol of Ag |
| Coupler (8) (as shown in Example 1) | 0.05 mol per mol of Ag |
| Coupler (21) | 0.003 mol per mol of Ag |

Seventh Layer: Second Red-Sensitive Emulsion Layer

Silver Iodobromide Emulsion (6 mol% iodine) silver coverage of 1.5 g/m²

-continued

| | |
|---|---|
| Sensitizing Dye III | $2.5 \times 10^{-5}$ mol per mol of Ag |
| Sensitizing Dye IV | $0.8 \times 10^{-5}$ mol per mol of Ag |
| Coupler (8) | 0.04 mol per mol of Ag |
| Coupler (14) | 0.02 mol per mol of Ag |

Eighth Layer: Yellow Filter Layer

Same as the sixth layer of Sample A.

Ninth Layer: First Blue-Sensitive Emulsion Layer

| | |
|---|---|
| Silver Iodobromide Emulsion (6 mol% iodine) | silver coverage of 1 g/m² |
| Coupler (5) | 0.25 mol per mol of Ag |

Tenth Layer: Second Blue-Sensitive Emulsion Layer

| | |
|---|---|
| Silver Iodobromide Emulsion (6 mol% iodine) | silver coverage of 1.1 g/m² |
| Coupler (5) | 0.06 mol per mol of Ag |

Eleventh Layer: Protective Layer

A gelatin layer containing polymethyl methacrylate (approximate molecular weight: 100,000) particles having a diameter of about 1.5 microns coated in an amount 0.03 g/m².

To the layers as described above, an appropriate amount of a hardening agent, a wetting agent, a surface active agent, and a thickener were added in addition to the aforesaid components.

The additional materials used for preparing Sample C were as follows:

Coupler (21): α-(4-Stearyloxybenzoyl)-α-(5- or 6-bromobenztriazolyl)-5-methoxyacetanilide.

Coupler (5): α-(2,4-Di-oxo-5,5-dimethyloxazolidinyl)-α-pivaloyl-2-chloro-5-[α-(2,4-di-t-amylphenoxy)butyramido]acetanilide.

Sample C was cut into a 16 mm. color negative film and the color photographic film was photographed in a still camera and processed using the same procedures as described in Example 1. The color negative material obtained from Sample C had dye images with excellent color purity and sharpness.

EXAMPLE 3

Sample D was prepared in the same manner as described in the case of preparing Sample C in Example 2 except that the couplers used in the sixth layer, the seventh layer, the ninth layer, and the tenth layer were replaced by the following couplers.

| | |
|---|---|
| Couplers in the Sixth Layer: | |
| Coupler (11) | 0.045 mol per mol of Ag |
| Coupler (21) | 0.002 mol per mol of Ag |
| Coupler (23) | 0.001 mol per mol of Ag |
| Couplers in the Seventh Layer: | |
| Coupler (11) | 0.004 mol per mol of Ag |
| Coupler (14) | 0.018 mol per mol of Ag |
| Coupler (23) | 0.0003 mol per mol of Ag |
| Coupler of the Ninth Layer: | |
| Coupler (16) | 0.23 mol per mol of Ag |
| Coupler of the Tenth Layer: | |
| Coupler (16) | 0.05 mol per mol of Ag |

The additional materials used for producing Sample D were as follows:

Coupler (11): 1-(2,4,6-Trichlorophenyl)-3-(2-chloro-5-tetradecyloxycarbonyl)anilino-5-pyrazolone.

Coupler (23): 1-Hydroxy-N-(2-chloro-5-hexadecyloxycarbonylphenyl)-4-(1-phenyl-2-tetrazolylthio)naphthamide.

Coupler (6): α-(4-Carboxyphenoxy)-α-pivaloyl-2-chloro-5-[α-(2,4-di-t-amylphenoxy)-butyramido]acetanilide.

From Sample D, a good color negative material was obtained as in the case of using Sample C in Example 2.

The present invention is useful for natural color recording photosensitive materials such as, in particular, reversal color photographic materials, negative color photographic materials of the type in which couplers are incorporated in the color photographic materials, color photographic papers, and transparent positive color photographic materials. Furthermore, the concepts of this invention are applicable to radiographic color photographic materials and also industrial monochromatic recording materials such as color photographic micro films and color photographic materials for recording drawings. Furthermore, the present invention is applicable to direct positive type color photographic materials including system which use silver halide emulsions which have been fogged before image exposure or silver halide emulsions which are fogged after or substantially simultaneously with image exposre.

While the invention has been described in detail and with reference to specific embodiments thereof, it will be apparent to one skilled in the art that various changes and modifications can be made therein without departing from the spirit and scope thereof.

What is claimed is:

1. A multilayer color photographic material comprising a support having coated thereon at least two photosensitive silver halide emulsion layer units which provide dye images having substantially different colors from each other by color development, each of said photosensitive emulsion layer units containing a coupler (A) capable of undergoing a coupling reaction with the oxidation product of a primary aromatic amine color developing agent and an interlayer color correction coupler (B) capable of providing an interlayer interimage effect, which provides a dye having a different color than that of the dye formed by the coupling reaction of said coupler (A) and the oxidation product of the primary aromatic amine color developing agent, wherein in said photosensitive emulsion layer units the dye images provided by said coupler (A) and said coupler (B) are of the same type, said couplers (A) and said interlayer color correction couplers (B) being couplers represented by the following general formula (I)

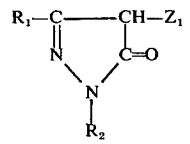

(I)

wherein $R_1$ represents an alkyl group, an aryl group, an alkoxy group, an aryloxy group, a heterocyclic ring, an amino group, a carbonamido group, or a ureido group; $R_2$ represents an alkyl group, an aryl group, or a heterocyclic group; and $Z_1$ represents a hydrogen atom or a group which is released or releases, in the case of the interlayer color correction coupler, a development inhibitor at color development; the general formula (II)

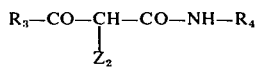

(II)

wherein $R_3$ represents an alkyl group or an aryl group; $R_4$ represents an aryl group; and $Z_2$ represents an hydrogen atom or a group which is released or releases, in the case of the interlayer color correction coupler, a development inhibitor at color development; the general formula (III)

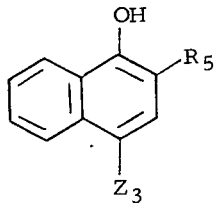

(III)

wherein $R_5$ represents a carbonyl group, a sulfamyl group, an alkoxycarbonyl group, or an aryloxycarbonyl group; and $Z_3$ represents a hydrogen atom or a group which is released or releases in the case of the interlayer color correction coupler, a development inhibitor at color development; or the general formula (IV)

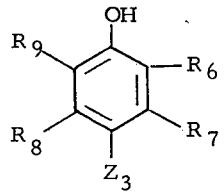

(IV)

wherein $R_6$ represents an alkyl group, an aryl group, a heterocyclic group, an amino group, a carbonamido group, a sulfonamido group, a sulfamyl group, or a carbamyl group; $R_7$, $R_8$, and $R_9$ each represents a hydrogen atom, an alkoxy group, an alkyl group, an aryl group, a heterocyclic group, an amino group, a carbonamido group, a sulfonamido group, a sulfamyl group, or a carbamyl group; and $Z_3$ represents a hydrogen atom or a group which is released or releases, in the case of the interlayer color correction coupler, a development inhibitor at color development.

2. The multilayer color photographic material as set forth in claim 1, in which said photosensitive emulsion layer unit contains the magenta coupler represented by the general formula (I) and the interlayer color correction yellow coupler represented by the general formula (II) as set forth in claim 1.

3. The multilayer color photographic material as set forth in claim 1, in which said photosensitive emulsion layer unit contains the magenta coupler represented by general formula (I) as set forth in claim 1 and the interlayer color correction cyan coupler represented by general formula (III) as set forth in claim 1.

4. The multilayer color photographic material as set forth in claim 1, in which said photosensitive emulsion layer unit contains the cyan coupler represented by general formula (III) or (IV) as set forth in claim 1 and the interlayer color correction yellow coupler represented by general formula (II) as set forth in claim 1.

5. The multilayer color photographic material as set forth in claim 2, in which said photosensitive emulsion layer unit contains the yellow coupler represented by general formula (II) as set forth in claim 2 and the interlayer color correction cyan coupler represented by general formula (III) as set forth in claim 2.

6. The multilayer color photographic material as set forth in claim 1, in which said photosensitive emulsion layer unit contains an interlayer color correction cyan coupler and a colored coupler.

7. The multilayer color photographic material as set forth in claim 1, in which said interlayer color correction coupler used in said photosensitive emulsion layer unit is an interlayer color correction yellow coupler.

8. The multilayer color photographic material as set forth in claim 1, in which said photosensitive emulsion layer unit is a green-sensitive emulsion layer unit and the unit contains a magenta coupler, an interlayer color correction yellow or cyan coupler, and further a 3-anilino-4-arylazo-5-pyrazolone coupler.

9. The multilayer color photographic material as set forth in claim 1, in which said color photographic material has on the support at least a blue-sensitive emulsion layer unit, a green-sensitive emulsion layer unit, and a red-sensitive emulsion layer unit.

10. The multilayer color photographic material as set forth in claim 9, in which the order of the emulsion layer units formed on the support is a. the red-sensitive emulsion layer unit, the green-sensitive emulsion layer unit, and the blue-sensitive emulsion layer unit:

b. the blue-sensitive emulsion layer unit, the red-sensitive emulsion layer unit, and the green-sensitive emulsion layer unit, or c. the blue-sensitive emulsion layer unit, the green-sensitive emulsion layer unit, and the red-sensitive emulsion layer unit.

11. A process for forming color photographic images which comprise imagewise exposing a multilayer color photographic material comprising a support having coated thereon at least two photosensitive silver halide emulsion layer units which provide dye images having substantially different colors from each other by color development, each of said photosensitive emulsion layer units containing a coupler (A) capable of undergoing a coupling reaction with the oxidation product of a primary aromatic amine color developing agent and an interlayer color correction coupler (B) capable of providing an interlayer interimage effect, which provides a dye having a different color than that of the dye formed by the coupling reaction of said coupler (A) and the oxidation product of the primary aromatic amine color developing agent, wherein in said photosensitive emulsion layer units the dye images provided by said coupler (A) and said coupler (B) are of the same type and developing the image exposed multilayer color photographic material with a color developer solution at a temperature of 30 to 60°C., said couplers (A) and said interlayer color correction couplers (B) being couplers represented by the following general formula (I)

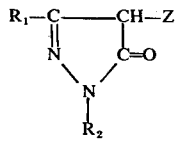

(I)

wherein $R_1$ represents an alkyl group, an aryl group, an alkoxy group, an aryloxy group, a heterocyclic ring, an amino group, a carbonamido group, or a ureido group; $R_2$ represents an alkyl group, an aryl group, or a heterocyclic group; and $Z_1$ represents a hydrogen atom or a group which is released or releases, in the case of the interlayer color correction coupler, a development inhibitor at color development; the general formula (II)

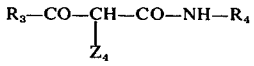

(II)

wherein $R_3$ represents an alkyl group or an aryl group; $R_4$ represents an aryl group; and $Z_2$ represents an hydrogen atom or a group which is released or releases, in the case of the interlayer color correction coupler, a development inhibitor at color development; the general formula (III)

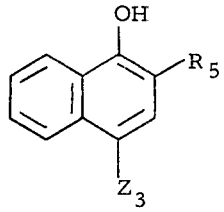

(III)

wherein $R_5$ represents a carbonyl group, a sulfamyl group, an alkoxy carbonyl group, or an aryloxycarbonyl group; and $Z_3$ represents a hydrogen atom or a group which is released or releases in the case of the interlayer color correction coupler, a development inhibitor at color development; or the general formula (IV)

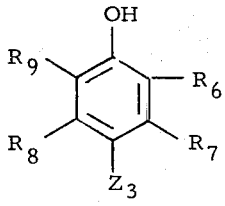

(IV)

wherein $R_6$ represents an alkyl group, an aryl group, a heterocyclic group, an amino group, a carbonamido group, a sulfonamido group, a sulfamyl group, or a carbamyl group; $R_7$, $R_8$, and $R_9$ each represents a hydrogen atom, an alkoxy group, an alkyl group, an aryl group, a heterocyclic group, an amino group, a carbonamido group, a sulfonamido group, a sulfamyl group, or a carbamyl group; and $Z_3$ represents a hydrogen atom or a group which is released or releases, in the case of the interlayer color correction coupler, a development inhibitor at color development.

* * * * *